US009182743B2

(12) United States Patent
Rochat et al.

(10) Patent No.: US 9,182,743 B2
(45) **Date of Patent: *Nov. 10, 2015**

(54) DISPLAY OF A PHYSICAL MAGNITUDE ON A TIMEPIECE DISPLAY BASE

(75) Inventors: Marco Rochat, Le Brassus (CH); Marc-Alexander Hayek, Le Brassus (CH)

(73) Assignee: BLANCPAIN SA, Le Brassus (CH)

( * ) Notice: Subject to any disclaimer, the term of this patent is extended or adjusted under 35 U.S.C. 154(b) by 0 days.

This patent is subject to a terminal disclaimer.

(21) Appl. No.: 14/122,415

(22) PCT Filed: Jun. 19, 2012

(86) PCT No.: PCT/EP2012/061723

§ 371 (c)(1), (2), (4) Date: Nov. 26, 2013

(87) PCT Pub. No.: WO2013/004491

PCT Pub. Date: Jan. 10, 2013

(65) Prior Publication Data

US 2014/0104991 A1 Apr. 17, 2014

(30) Foreign Application Priority Data

Jul. 7, 2011 (EP) ..... 11173107

(51) Int. Cl.
*G04B 5/02* (2006.01)
*G04B 9/00* (2006.01)
(Continued)

(52) U.S. Cl.
CPC ..... *G04B 19/025* (2013.01); *G04B 19/22* (2013.01); *G04B 19/262* (2013.01); *G04B 19/268* (2013.01); *G04B 45/02* (2013.01); *G04B 47/066* (2013.01); *G04F 7/0866* (2013.01)

(58) Field of Classification Search
CPC ..... G04B 9/00; G04B 9/005; G04B 5/16; G04B 5/165; G04B 45/0038; G04B 45/0046; G04B 19/025; G04B 19/22; G04B 19/262; G04B 19/268; G04B 45/02; G04B 45/066; G04F 7/0866
USPC ..... 368/148, 206–208, 210, 212, 229, 223
See application file for complete search history.

(56) References Cited

U.S. PATENT DOCUMENTS 4,421,421 A * 12/1983 Bradt ..... 368/229
4,583,864 A * 4/1986 Graves ..... 368/17
(Continued)

FOREIGN PATENT DOCUMENTS

CH 700 222 A1 7/2010
EP 0 921 451 A 6/1999
(Continued)

OTHER PUBLICATIONS

International Search Report for PCT/EP2012/061723 dated Aug. 23, 2012.

*Primary Examiner* — Vit W Miska
*Assistant Examiner* — Matthew Powell
(74) *Attorney, Agent, or Firm* — Sughrue Mion, PLLC

(57) ABSTRACT

Timepiece movement driving at least one output wheel set, from a means of generating a time magnitude, or a means of detecting the magnitude of the state of a control member of this movement, or a device for measuring a physical magnitude, the position of this output wheel set being linked to an instantaneous value of this magnitude, displayed on a swiveling display base and including a display wheel set cooperating with this output wheel set, this display wheel set being permanently coupled to this output wheel set and this movement including a supplementary wheel set pivoting synchronously or in an integer pivoting velocity ratio relative to supplementary wheel set.

21 Claims, 8 Drawing Sheets

(51) Int. Cl.

| | |
|---|---|
| ***G04B 19/02*** | (2006.01) |
| ***G04F 7/08*** | (2006.01) |
| ***G04B 19/22*** | (2006.01) |
| ***G04B 19/26*** | (2006.01) |
| ***G04B 45/02*** | (2006.01) |
| ***G04B 47/06*** | (2006.01) |

(56) References Cited

U.S. PATENT DOCUMENTS

| | | | | |
|---|---|---|---|---|
| 4,666,312 | A * | 5/1987 | Mukoyama | 365/179 |
| 6,685,352 | B1 * | 2/2004 | Capt et al. | 368/206 |
| 2003/0031093 | A1 * | 2/2003 | Zaugg | 368/80 |
| 2005/0018542 | A1 * | 1/2005 | Dias | 368/35 |
| 2005/0128881 | A1 * | 6/2005 | Gueissaz | 368/204 |
| 2005/0281136 | A1 * | 12/2005 | Wilmouth et al. | 368/28 |
| 2009/0003137 | A1 * | 1/2009 | Courvoisier et al. | 368/18 |
| 2009/0129211 | A1 * | 5/2009 | Rochat | 368/208 |
| 2009/0257323 | A1 * | 10/2009 | Soltani | 368/281 |
| 2010/0002545 | A1 * | 1/2010 | Kitahara et al. | 368/37 |
| 2011/0182152 | A1 * | 7/2011 | Jouvenot | 368/212 |
| 2011/0205857 | A1 * | 8/2011 | Beccia et al. | 368/208 |
| 2012/0287762 | A1 * | 11/2012 | Mintiens | 368/233 |

FOREIGN PATENT DOCUMENTS

| | | |
|---|---|---|
| EP | 2 141 558 A2 | 1/2010 |
| EP | 2 360 535 A1 | 8/2011 |

* cited by examiner

DISPLAY OF A PHYSICAL MAGNITUDE ON A TIMEPIECE DISPLAY BASE

This a National Phase Application in the United States of International Patent Application PCT/EP2012/061723 filed Jun. 19, 2012 which claims priority on European Patent Application No. 11173107.1 of Jul. 7, 2011. The entire disclosures of the above patent applications are hereby incorporated by reference.

FIELD OF THE INVENTION

The invention concerns a timepiece movement driving at least one output wheel set, from a source of motion secured to a plate or a bridge comprised in said movement, said source of motion being formed, either by a means of generating a time magnitude, or a means of detecting the magnitude of the state of a control member of said movement, or a means of measuring or of storing a physical magnitude external to said movement, the position of said output wheel set being linked to an instantaneous value of said magnitude, respectively of said time magnitude, or said magnitude of a state, or of said physical magnitude, according to the nature of said source of motion.

The invention also concerns a timepiece including at least one such timepiece movement.

The invention concerns the field of horology, and more specifically watches, in particular mechanical watches.

BACKGROUND OF THE INVENTION

When a timepiece, particularly a watch, is provided with several complications, it is difficult to accommodate these complications, both inside the watch case, and as regards the visible surface or surfaces of the complications, since most complications are connected to a visual display. Each dial is relatively rapidly filled where several complications are juxtaposed, and it is useful to utilise every available surface.

There is known from CH Patent No 330897, in the name of Fabrique d'Horlogerie de Fontainemelon SA, a self-winding mechanism, wherein an oscillating weight is made in the form of a frame and carries several winding wheel sets, but does not carry any display functions.

EP Patent No 2141558, in the name of Les Artisans Horlogers Sàrl, discloses a watch whose entire movement and the display carried thereby, pivots in a peripheral part and thus forms an oscillating weight of the self-winding mechanism. The object of this original arrangement is to give the time display a determined stable position, and to hold, by gravity, the plane of the balance in a reference plane regardless of the spatial orientation of the watch case. This design does not allow for the placement of additional displays, especially since it uses up space in the case, in particular to ensure the operation of the stem, which is made in two parts.

It is known from EP Patent No 1826633, in the name of Blancpain SA, to use the oscillating weight of a self-winding watch to carry a power reserve display member. EP Patent Application No 2360535 A1 in the name of Blancpain SA also discloses a device of this type, wherein a hand and a dial for displaying the power reserve are mounted to rotate synchronously relative to the oscillating weight.

CH Patent No 700222 in the name of La Fabrique du Temps SA discloses a timepiece movement wherein the oscillator and the escape wheel are mounted on the oscillating weight of a self-winding mechanism, and drive an output wheel. The escape wheel is carried, in particular, by a tourbillon carriage mounted on the oscillating weight and carrying the mechanical oscillator. In a "Cartier Astrorégulateur®" watch, made in accordance with this arrangement, the output wheel drives the hour and minute motion work, whereas the seconds hand remains integral with the arbour of the tourbillon carriage and is in constant rotation relative to the rotor.

SUMMARY OF THE INVENTION

In short, in complicated timepieces, particularly in watches, it is desirable to utilise all the available space. In particular, in the case of watches, some are provided with pivoting elements, in particular oscillating weights in the case of self-winding watches, whose large frontal surface is not usually, or only rarely, used as a display base.

The invention proposes to utilise the frontal surface of these pivoting elements, either on the front of the watch, or on the back for a reversible watch, or for a display that is consulted less frequently than the front display, as an additional display surface.

The invention proposes more particularly to achieve the display of magnitudes connected to elapsed time, particularly by extracting information from an hour wheel or similar, and/or a state display, for example relative to the position of a pusher or a selector, and/or a display of the value of a physical magnitude external to the timepiece measured by a sensor integrated in the timepiece or by a sensor transmitting a value to a received integrated in the timepiece; said physical magnitude may be, for example, an air or water pressure value, a temperature, magnetic field, radioactivity or similar value.

The invention therefore concerns a timepiece movement driving at least one output wheel set, from a source of motion secured to a plate or a bridge comprised in said movement, said source of motion being formed, either by a means of generating a time magnitude, or a means of detecting a magnitude of the state of a control member of said movement, or a means of measuring or storing a physical magnitude, the position of said output wheel set being connected to an instantaneous value of said magnitude, respectively of said time magnitude, or of said magnitude of a state, or of said physical magnitude external to said movement, according to the nature of said source of motion, characterized in that said instantaneous value is displayed on a display base swivelling relative to said source of motion and including at least one display wheel set cooperating with said output wheel set with which it is permanently coupled, directly or via a gear train, and further characterized in that said display base carries at least one supplementary wheel set pivoting synchronously, or in an integer pivoting velocity ratio relative to said display wheel set.

According to a feature of the invention, said timepiece movement includes at least a second output wheel set arranged either to take a position connected to the instantaneous value of another physical magnitude, or to define a total variation range or a scale of magnitude of the value of the magnitude which defines the position of said first output wheel set.

According to a feature of the invention, said display base includes a plurality of display wheel sets which either all cooperate with a single supplementary display wheel set, or each cooperate with a particular supplementary display wheel set.

The invention also concerns a timepiece including at least one such timepiece movement.

BRIEF DESCRIPTION OF THE DRAWINGS

Other features and advantages of the invention will appear more clearly upon reading the following detailed description, with reference to the annexed drawings, in which.

DETAILED DESCRIPTION OF PREFERRED EMBODIMENTS

Figure 1:
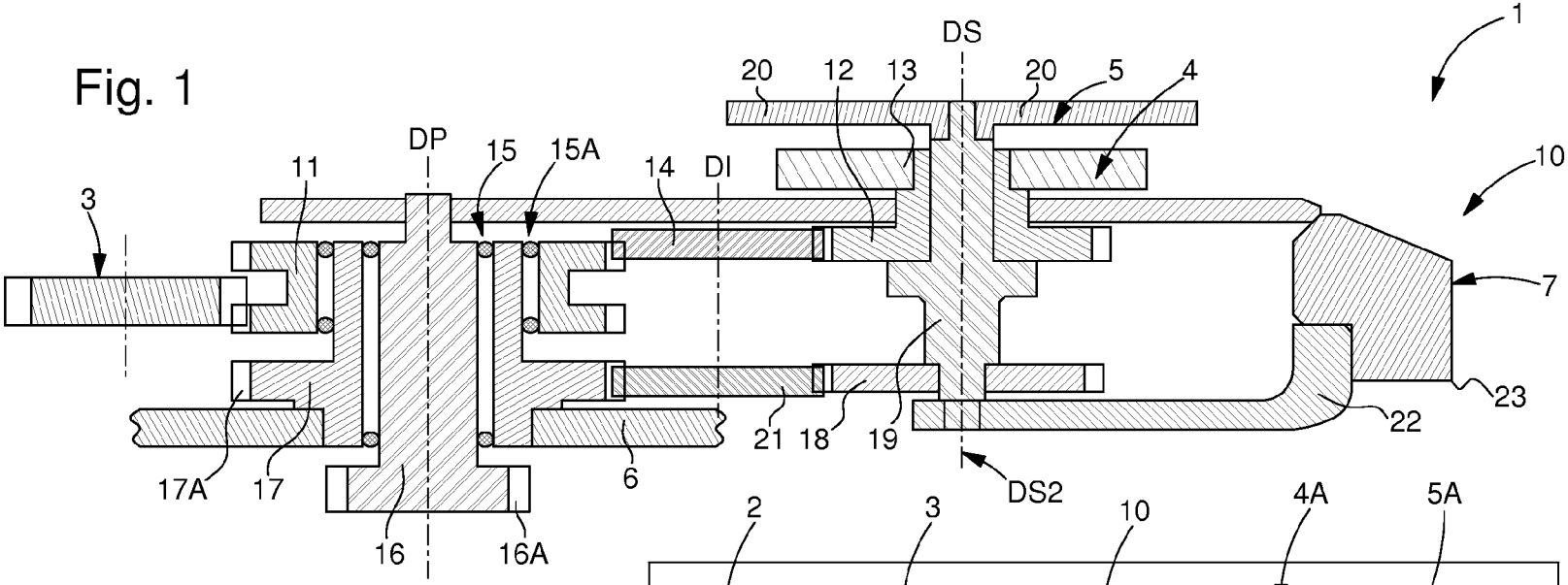
FIG. 1 shows a schematic cross-section, in a plane through a pivot axis, of a timepiece movement with a pivoting display base according to the invention, in an embodiment with one input connected to a source of motion, and including a display output and a supplementary display output which are coaxial, arranged so that the supplementary display is moved parallel to itself during the pivoting motion of the display base, and thus remains easy for the user to read.

The invention concerns the field of horology, and more specifically watches, in particular mechanical watches.

As shown in the Figures, the invention concerns a timepiece movement 1. This movement 1 drives at least one output wheel set 3, from a source of motion 2 fixed to a plate or bridge 6 comprised in movement 1.

Source of motion 2 is formed:

- either by a means 2A of generating a time magnitude,
- or by a means 2B of detecting the magnitude of the state of a control member of said movement,
- or by a means 2C of measuring or of storing a physical magnitude external to said movement.

The position of said output wheel set 3 is connected to an instantaneous value of the magnitude, respectively of the time magnitude, or the magnitude of the state, or the physical magnitude, according to the nature of source of motion 2.

According to the invention, the instantaneous value of this magnitude is displayed on display base 10. This display base 10 for displaying the value of this magnitude is mounted to swivel about a main pivot axis DP relative to the plate or to the bridge 6 of movement 1. Display base 10 includes at least one display wheel set 4, cooperating with output wheel set 3 with which it is permanently coupled, directly or via a gear train.

According to the invention, display base 10 also carries at least one supplementary wheel set 5 pivoting synchronously or in an integer pivoting velocity ratio relative to display wheel set 4.

Preferably, but not restrictively, display base 10 includes a means of kinematic connection to an oscillating weight 7 of a self-winding mechanism, or forms, as shown in the Figures, a self-winding oscillating weight. This means of kinematic connection may consist, depending upon the case, of permanently coupled direct drive means which is preferred in the present applications, or of uncouplable drive means, particularly using friction.

Figure 2:
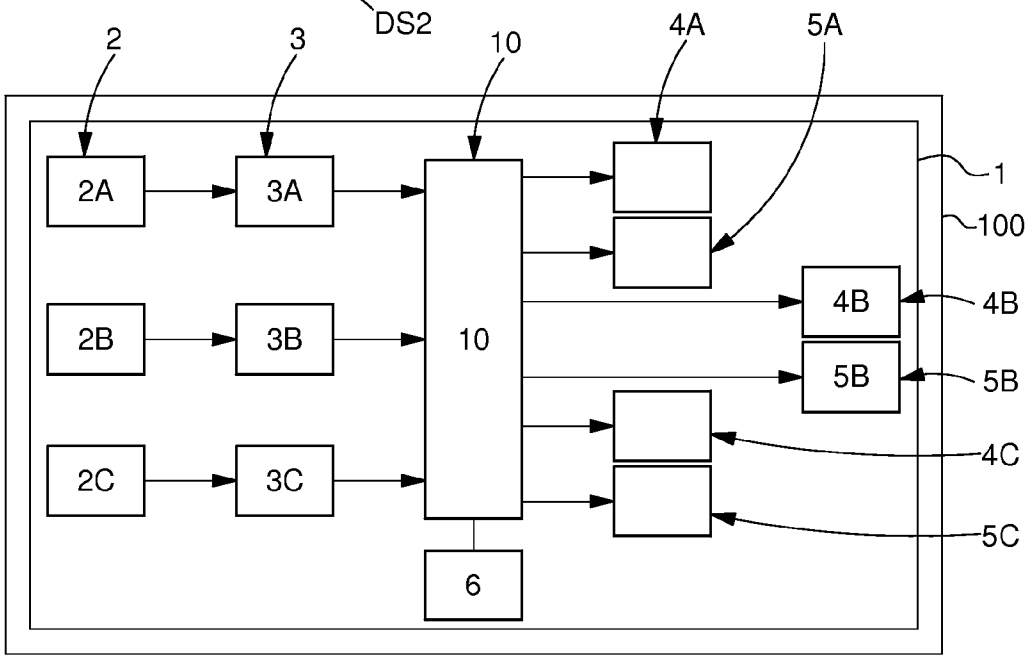
FIG. 2 shows a block diagram of a timepiece including a movement according to the invention, provided with a pivoting display base of this type, shown here with three sources of motion corresponding to magnitudes of different natures, each connected to an input and, said display base carrying, for each input, a particular output display and supplementary output display.
Figure 3:
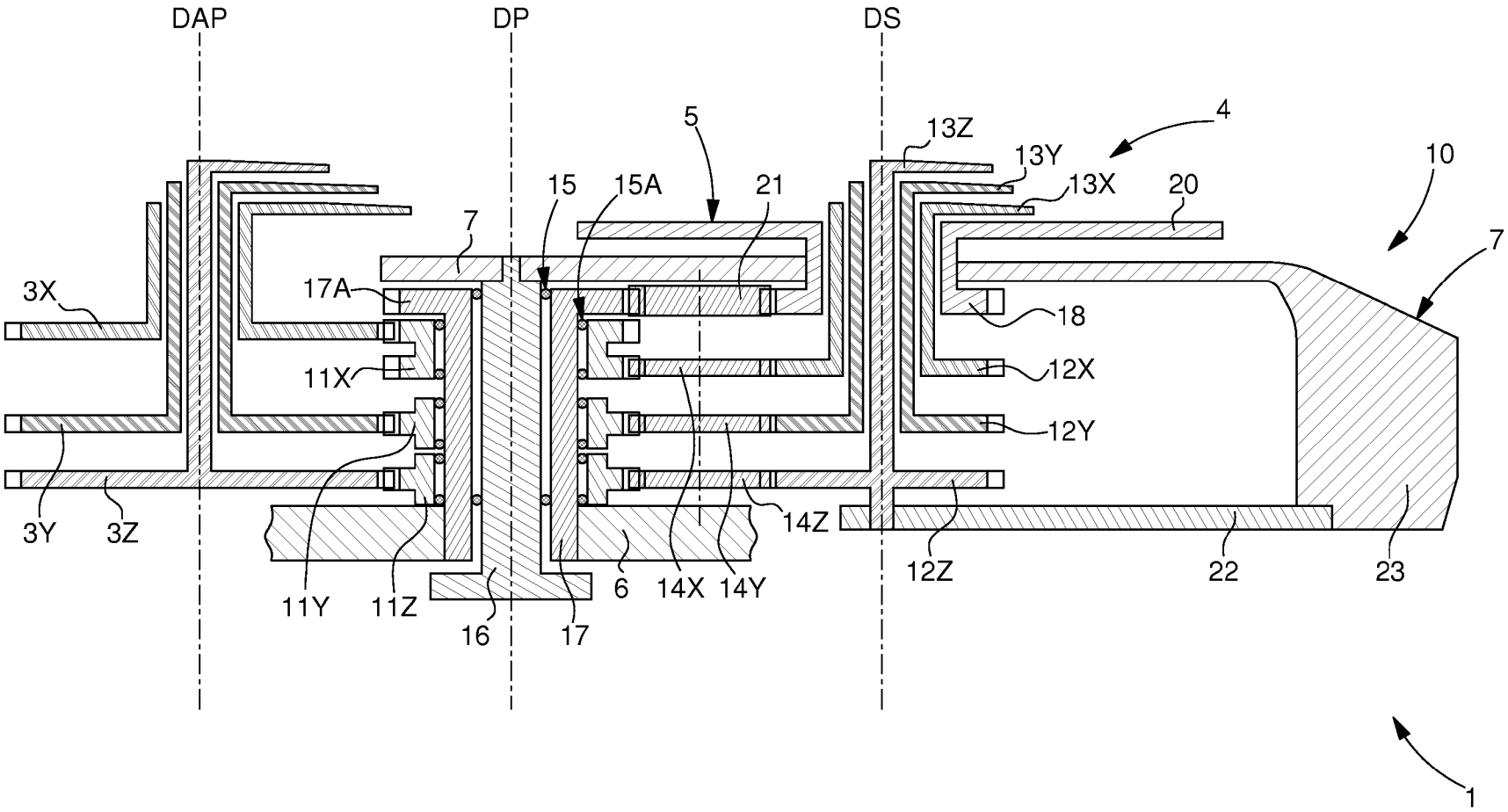
FIG. 3 shows, in a similar manner to FIG. 1, a pivoting display base according to the invention, in an embodiment with three inputs connected to a source of motion and each integral here with a hand, and including an output display for each of these inputs, also formed here by a hand, and a single supplementary output display for these three output displays which is coaxial to said output displays.
Figure 5:
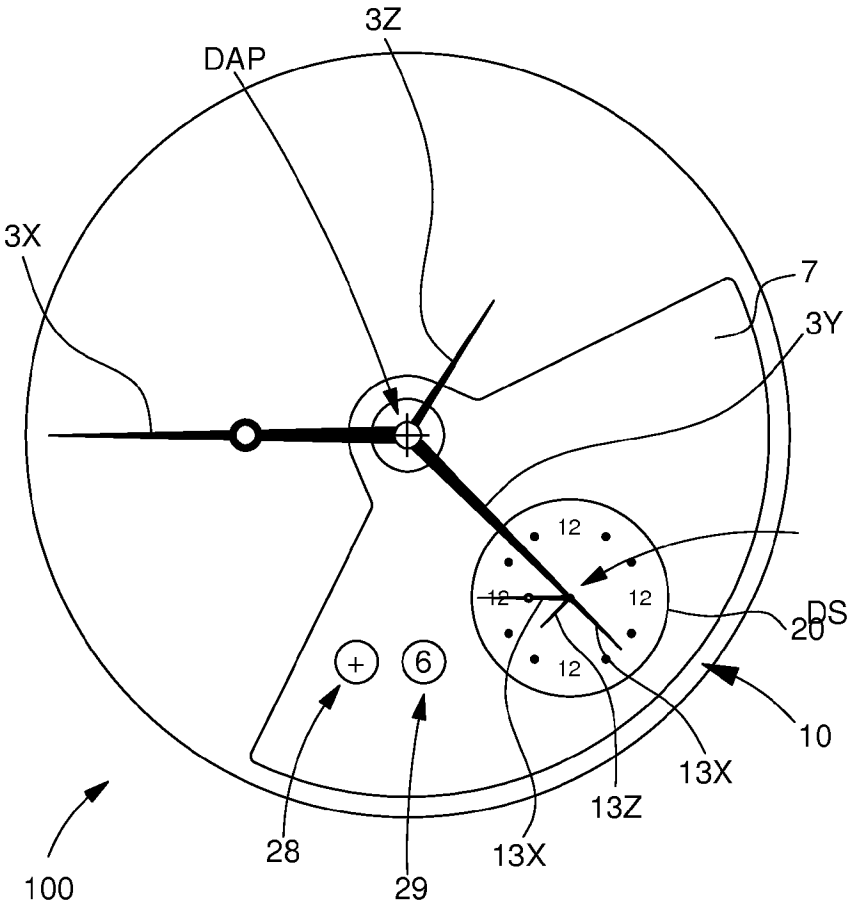
FIG. 5 shows a variant of FIG. 4, wherein the secondary display is a time zone display, and displays the time in a different time zone from that of the main display; in this embodiment, two additional apertures in the oscillating weight display the sign and value of the time difference between the second time zone displayed on the oscillating weight, and the first time zone of the central display.
Figure 6:
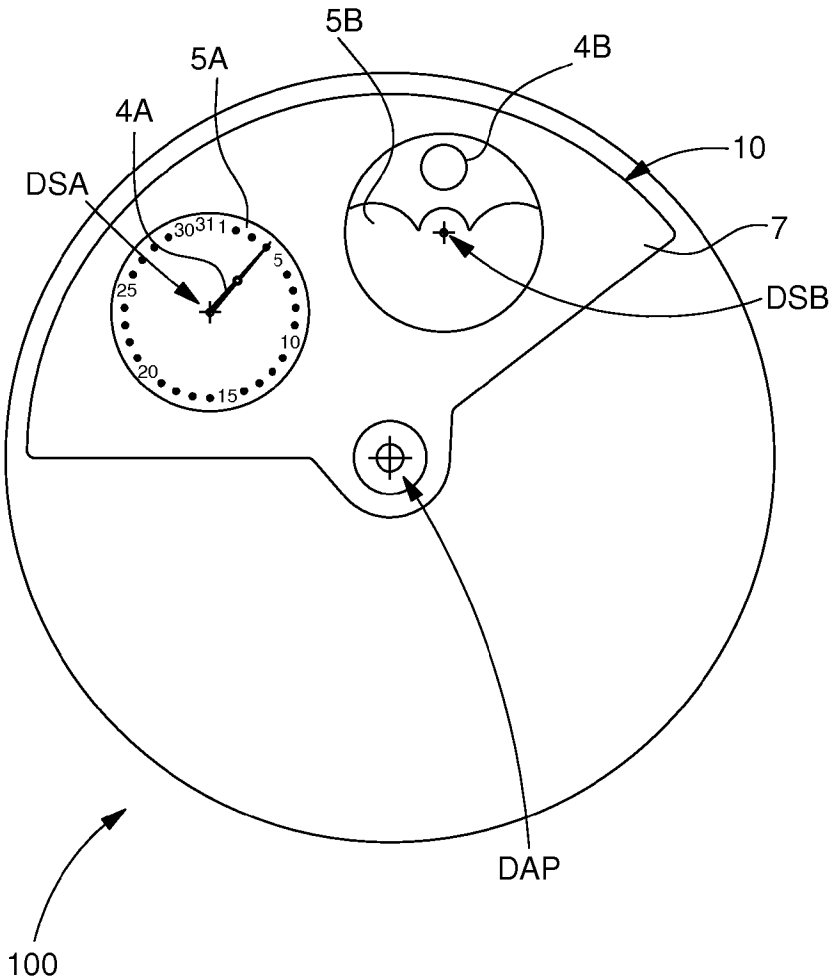
FIG. 6 shows, in a similar manner to FIG. 4, a timepiece, such as a watch, including a movement provided with a pivoting display base, wherein a first secondary display made on an oscillating weight is dedicated to the display of the date, while a second secondary display is dedicated to the moon phase display.
Figure 9:
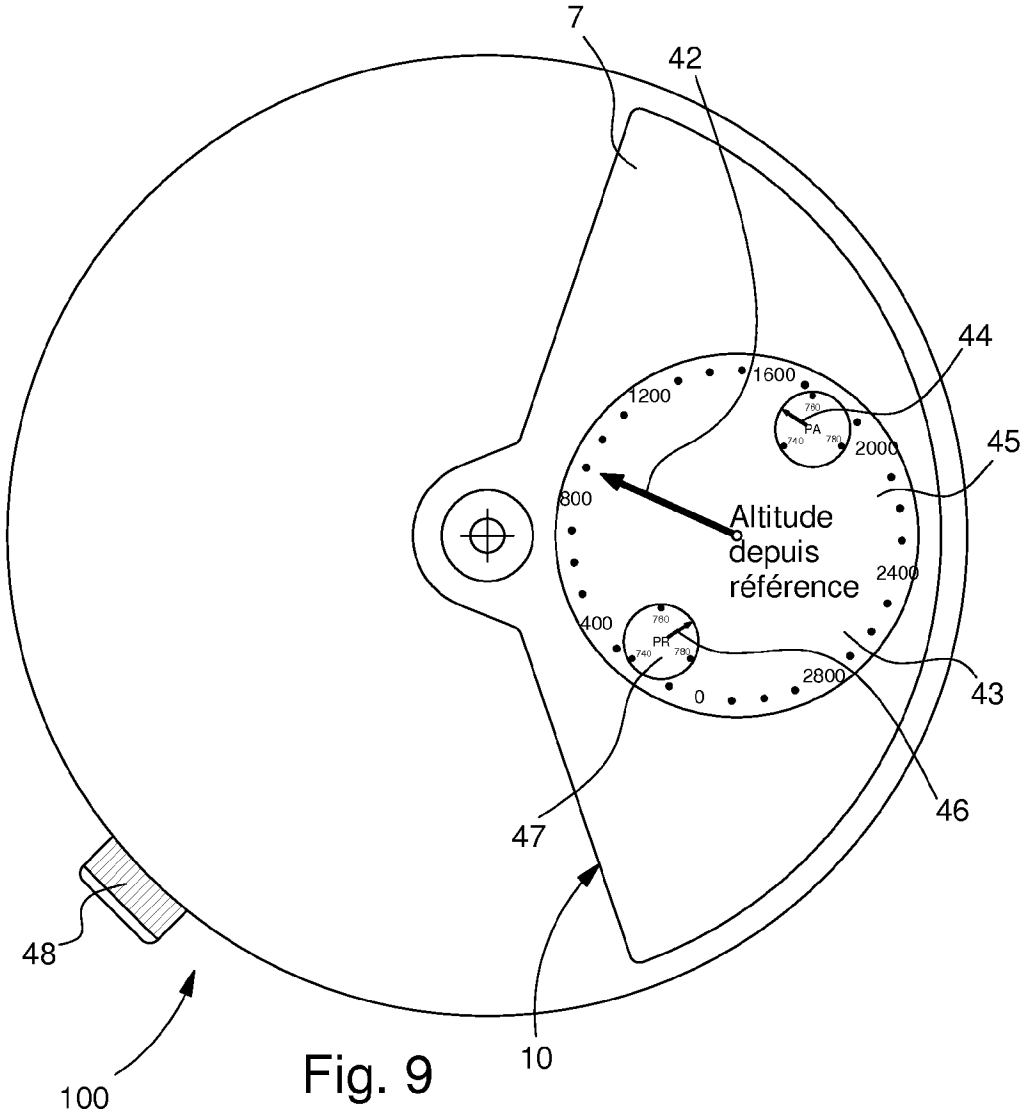
FIG. 9 shows, in a similar manner to FIG. 4, a timepiece, such as a watch, including a movement provided with a pivoting display base, wherein a first secondary display made on an oscillating weight is dedicated to the display of an altitude relative to the reference location, while a second secondary display is dedicated to the display of the atmospheric pressure of the place where the timepiece is located, and a third secondary display displays the atmospheric pressure of the reference location, which results from a measurement in said reference location, or from a setting via a signal or via the user.

In various embodiments, as seen in FIGS. 2 to 7, 9 and 11, display base 10 includes a plurality of display wheel sets, which, either all cooperate with a single supplementary display wheel set 5 as in the case of FIG. 3, or each cooperate with a particular supplementary display wheel set, as seen in FIGS. 2, 6 and 9.

FIG. 2 illustrates, for example, a movement 1 including three sources of motion 2 of different types 2A, 2B, 2C, as set out above, each driving an output wheel set respectively 3A, 3B, 3C, which drives display means and supplementary display means, respectively 4A/5A, 4B/5B, 4C/5C.

FIG. 1 illustrates the case of a movement 1 with a single output wheel set 3. Display base 10 is formed here by a self-winding oscillating weight 7, which in turn includes a weight body 23 and a weight bridge 22, which together delimit a chamber arranged for accommodating a gear train.

A cannon-pinion 17 is fixedly secured to the plate or bridge 6 of movement 1 and carries a peripheral toothing 17A used as angular pivot reference for oscillating weight 7 about a main pivot axis DP. This cannon-pinion 17 serves as a pivotal guide for an arbour 16, mounted integrally with oscillating weight 7 and which carries a peripheral toothing 16A for the transmission of kinetic energy to a barrel ratchet (not shown here). This pivotal guide may be formed, in particular, by a ball bearing or similar. Cannon-pinion 17 also serves as a pivotal guide for an input wheel 11, arranged to mesh permanently with output wheel set 3. The meshing is shown as being direct, but could include intermediate wheel sets without departing from the invention, provided that input wheel 11 is still driven, directly or indirectly, by output wheel set 3. The guiding of input wheel set 11 is also advantageously achieved using a ball bearing.

Oscillating weight 7 carries a display wheel set 4, which is arranged to pivot about a first secondary pivot axis DS1 carried by display base 10. According to the invention, display wheel set 4 is permanently coupled, directly or indirectly, to the first output wheel set 3. In FIG. 1, which shows in particular a moon phase display, display wheel set 4 includes a moon phase disc 13 fixed to a wheel 12, which is connected to input wheel 11 via an intermediate gear train 14 pivoting about an intermediate axis D1. The at least one supplementary display wheel set 5 is arranged to pivot about a second secondary pivot axis DS2 also carried by display base 10, the second secondary pivot axis DS2 being parallel to or merged with the first secondary pivot axis DS1. In FIG. 1, DS1 and DS2 are merged and form a single secondary pivot axis DS, and the supplementary display wheel set includes a moon cover 20, fixed to an arbour 19, which carries a wheel 18, which meshes with an intermediate train 21. Advantageously, arbour 19 is guided by wheel 12. Intermediate gear train 21 meshes with toothing 17A of cannon-pinion 17, and the gear ratios are selected, both in the drive train of display wheel set 4 and that of supplementary display wheel set 5, so that the pivoting of moon cover 20 compensates for that of oscillating weight 7 by a reverse motion, and so that the pivoting of moon phase disc 13 relative to moon cover 20 appears to the user to occur as though the moon phase disc and moon cover were both fixed relative to the plate or bridge 6. FIG. 6 shows a front view of this moon phase display function where display means 4B is a moon phase disc and supplementary display means 5B is a moon cover, and they pivot together about a secondary axis DSB.

Figure 11:
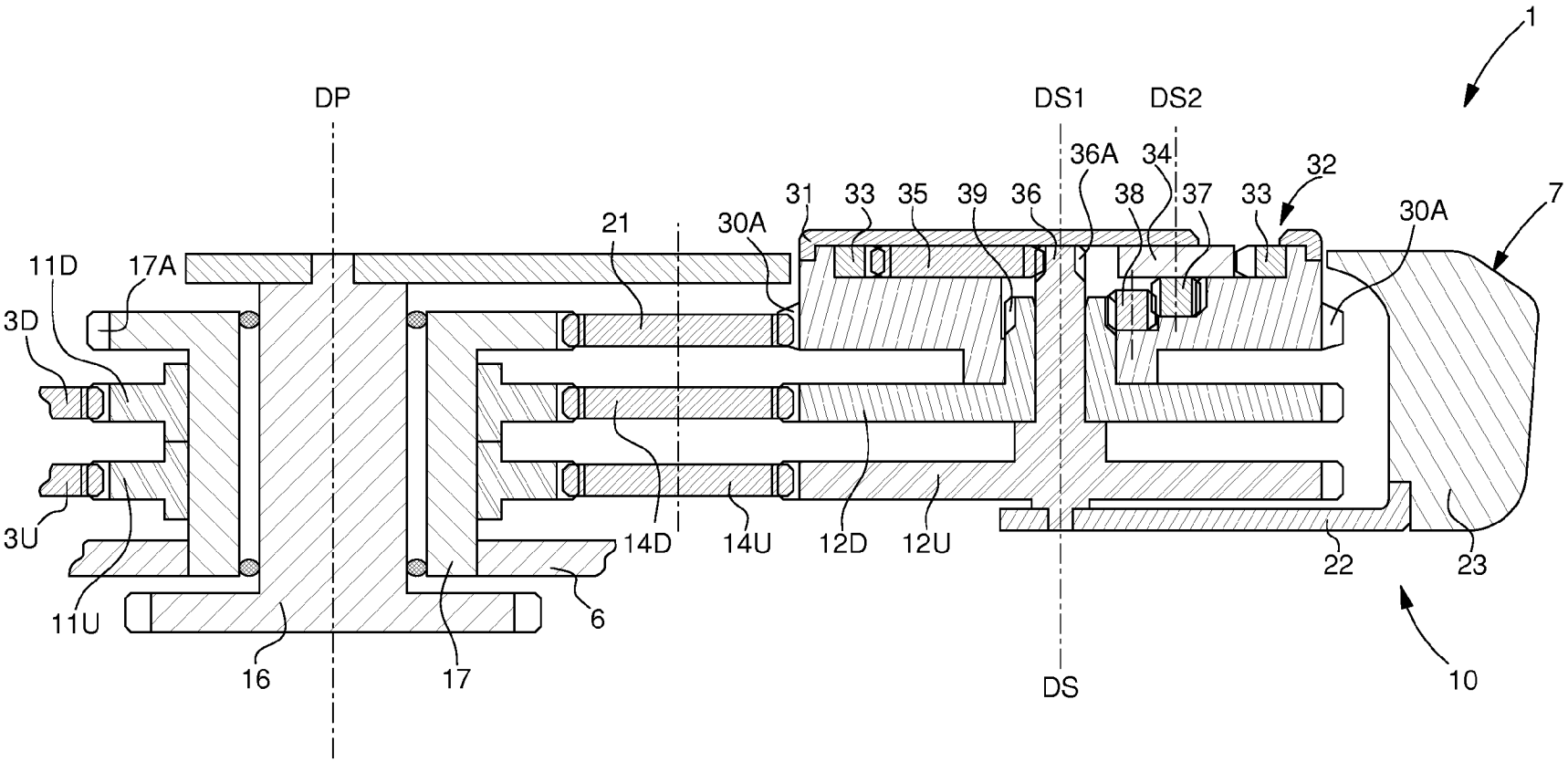
FIG. 11 shows, in a similar manner to FIG. 1, a movement with a pivoting display base according to the invention, in an embodiment with two inputs connected to a source of motion, one connected to the tens of a date and the other to the units of the date, and including an output display for each of these inputs, respectively formed by a tens wheel and a unit crown, respectively pivoting about second and first secondary pivot axes, and a single supplementary output display for these two output displays which carries both, in addition to a cover including a read aperture which only reveals the current date.
Figure 12:
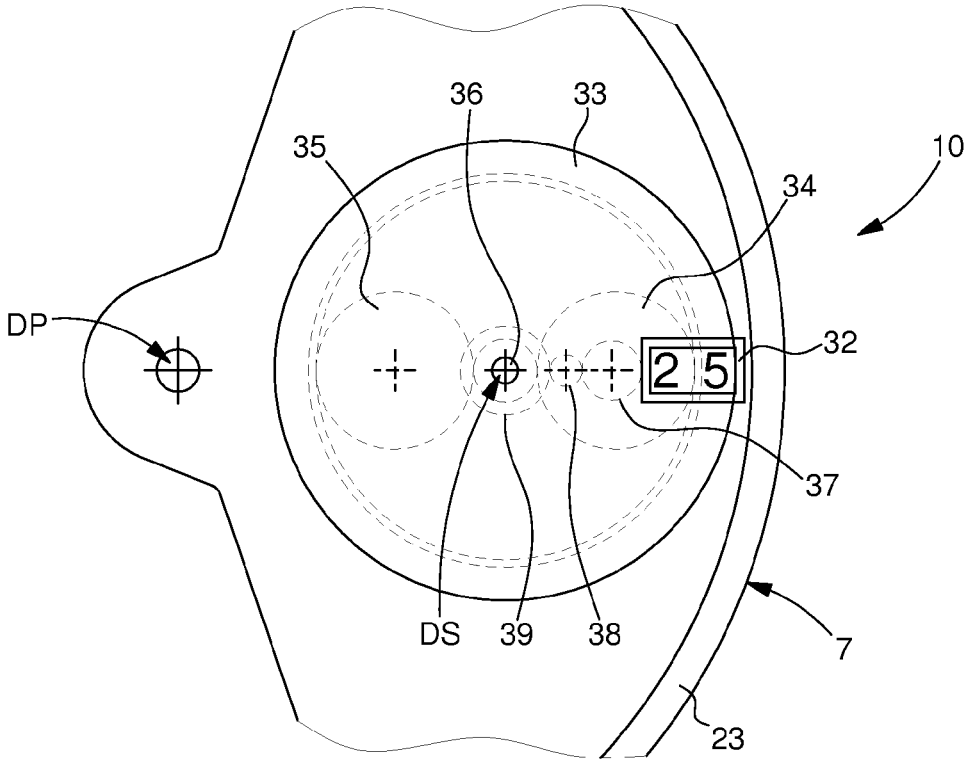
FIG. 12 is a schematic front view of the display base of FIG. 11.
Figure 13:
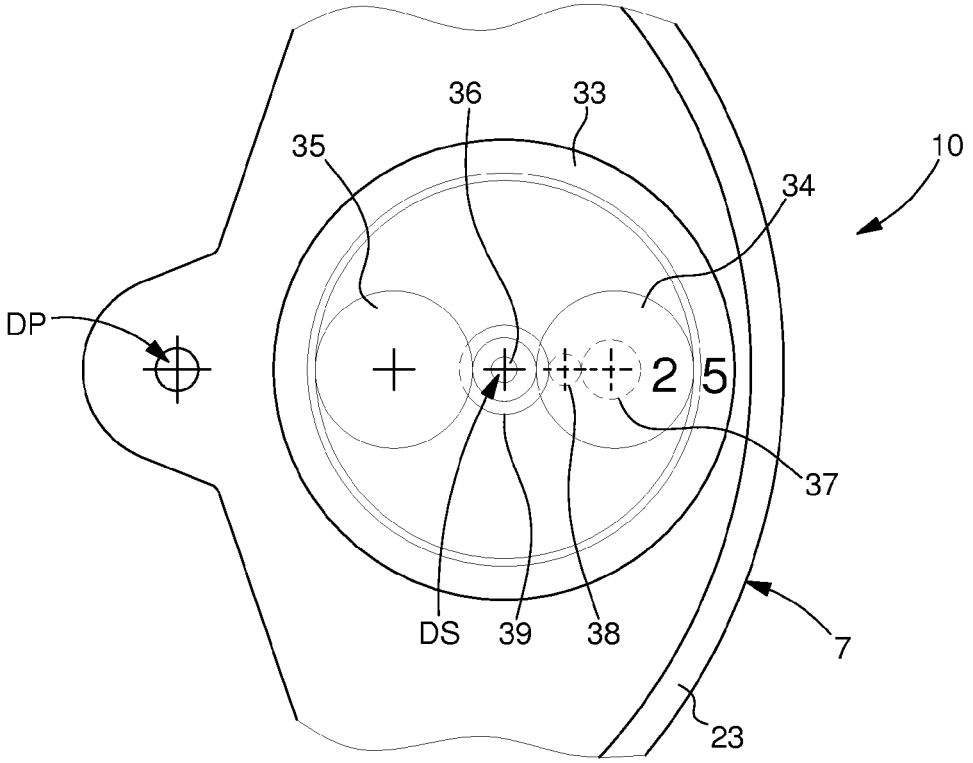
FIG. 13 is a similar view to FIG. 12, with the cover and aperture omitted.

In a particular embodiment, as shown in FIG. 2, 3 or 11, movement 1 includes at least a second output wheel set, which is arranged, either to take a position connected to the instantaneous value of another physical magnitude, or to define a total variation range or a scale of magnitude of the value of the magnitude which defines the position of the first output wheel set 3.

FIG. 3 thus shows a display base 10, in an embodiment with three output wheel sets 3X, 3Y, 3Z, which are connected to a source of motion formed of drive means and of the oscillator, these three outputs respectively corresponding, each integral with a hand, to the central display of the seconds, minutes and hours about a main pivot axis DAP. Display base 10 includes an output display, respectively 13X, 13Y, 13Z for each of these inputs, also formed here by a hand, and a single supplementary output display 5 for these three output displays which is coaxial thereto, and which is formed here by a dial 20. In a similar manner to FIG. 1, the output displays 13X, 13Y, 13Z are each integral with a wheel 12X, 12Y, 12Z which meshes with an intermediate gear train 14X, 14Y, 14Z, which in turn meshes with an output wheel 11X, 11Y, 11Z cooperating with the three outputs 3X, 3Y, 3Z. Dial 20 forming the supplementary display means common to the various display means, is fixed to a wheel 18 connected via an intermediate gear train 21 to toothing 17A which gives the angular position of oscillating weight 7, which forms here the carrier structure of display base 10, in order, as in the FIG. 1 example, to keep the axes of dial 20 parallel to those of the dial of the main set of hands, so that, except for the position of the secondary pivot axis DS which describes a circle about pivot axis DP, the dial permanently remains in the same angular orientation relative to the plate or bridge 6 of movement 1, and to the case of timepiece 100 containing said movement.

Figure 4:
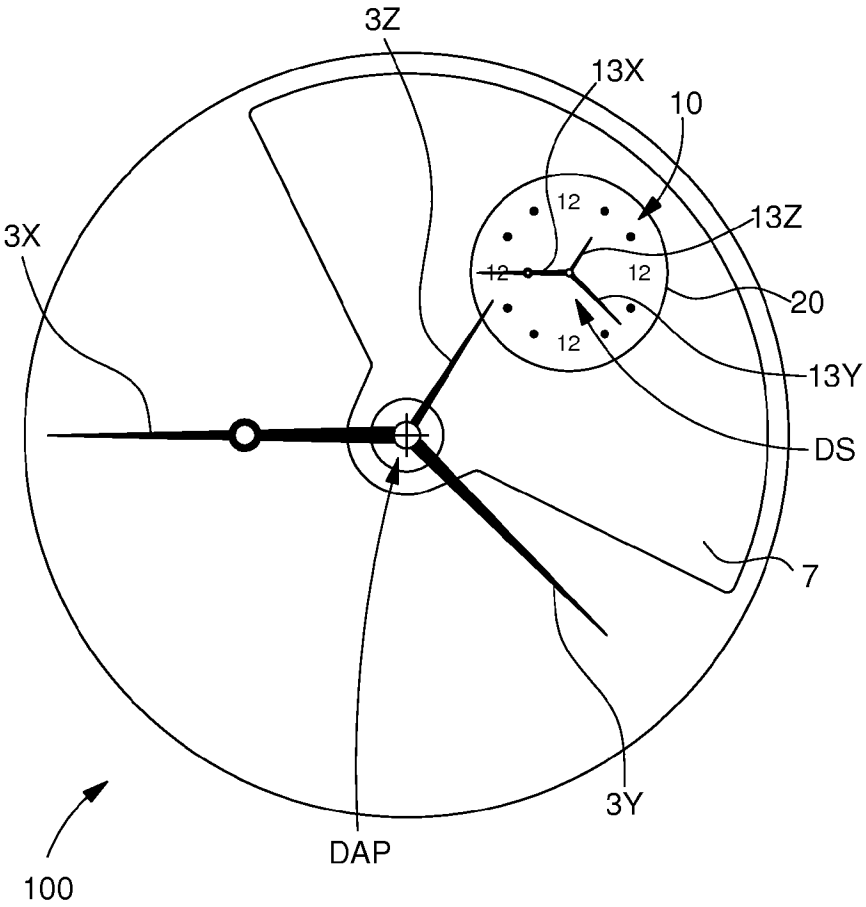
FIG. 4 shows a schematic front view of a timepiece, such as a watch, including a movement provided with a pivoting display base according to FIG. 3, and wherein a secondary display formed on an oscillating weight replicates a centred main display in the timepiece.

FIG. 4 shows a watch 100 including display base 10 of FIG. 3, wherein a secondary display made on an oscillating weight 7 replicates a centred main display on timepiece 100.

The variant shown in FIG. 5 has a secondary display which is a time zone display, and displays the time in a different time zone to that of the main display. In this embodiment, two additional apertures 28, 29 in oscillating weight 7 display the sign and value of the time difference between the second time zone displayed on oscillating weight 7 and the first time zone of the central display. It is naturally possible to apply this time zone display to minute hand 13Y, as well as hour hand 13X, for countries having a time difference of half an hour, such as India, Iran, Afghanistan or Iran, or a quarter of an hour, such as Nepal.

FIG. 6 shows a watch 100 with a first secondary display made on an oscillating weight 7, dedicated to the date display, with a display means 4A formed by a hand, and a supplementary display means 5A formed by a dial, both pivotably moveable about a secondary axis DSA. A second secondary display on the same oscillating weight 7 is dedicated to the moon phase display with a display means 4B formed by a moon phase disc, and a supplementary display means 5B formed by a moon cover, both pivotably moveable about secondary axis DSB.

Figure 7:
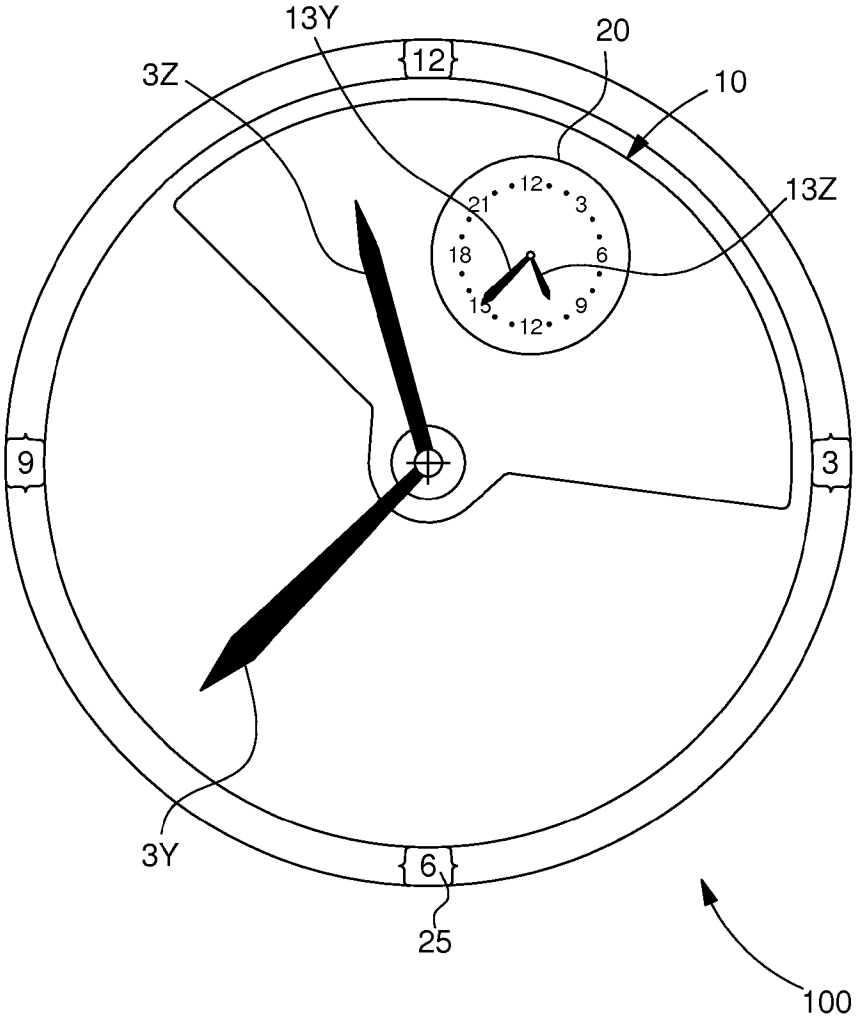
FIG. 7 shows, in a similar manner to FIG. 4, a timepiece, such as a watch, including a movement provided with a pivoting display base, wherein a secondary display formed on an oscillating weight is dedicated to the display of the 24 hour time, whereas the central main display is a conventional 12 hour display.

FIG. 7 shows a watch 100 with a movement 1, not visible in the Figure, provided with a pivoting display base 10, wherein a secondary display made on an oscillating weight is dedicated to the 24 hour time display using hands 13Y and 13Z facing a dial 20, whereas the central main display is a conventional 12 hour display using hands 3Y and 3Z facing a main dial 25.

Figure 8:
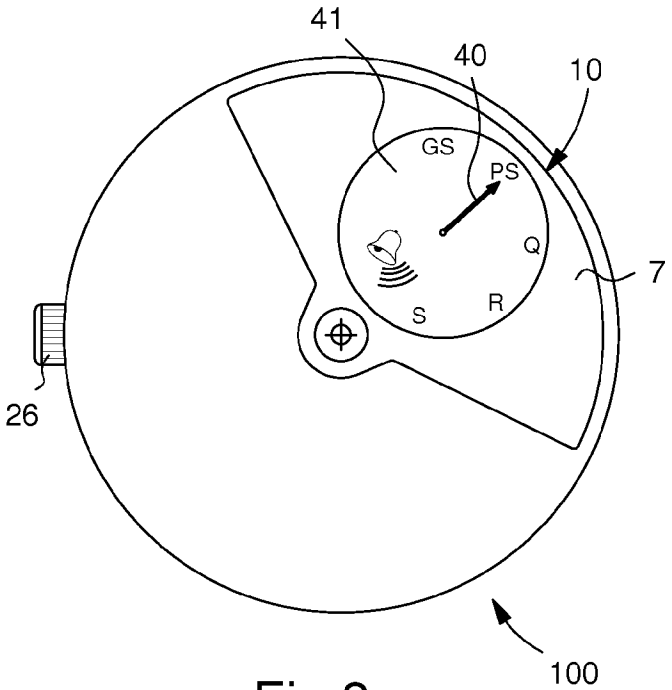
FIG. 8 shows, in a similar manner to FIG. 4, a timepiece, such as a watch, including a movement provided with a pivoting display base, wherein a secondary display formed on an oscillating weight is dedicated to the display of the state of selection of a striking mechanism; grand strike, small strike, quarters, alarm, silence.

FIG. 8 shows a watch 100 including a movement 1, not visible in the Figures, provided with a pivoting display base 10, where a secondary display made on an oscillating weight 7 is dedicated to the display of the state of selection of a striking mechanism, the selection being made by a pusher 26: grand strike, small strike, quarters, alarm, silence, by a hand 40 facing a state indicator dial 41.

FIG. 9 shows a watch 100 including a movement 1, not visible in the Figure, provided with a pivoting display base 10, wherein a first secondary display made on an oscillating weight 7 is dedicated to the display of an altitude relative to a reference location by a hand 42 facing a dial 43, both of which pivot, whereas a second secondary display is dedicated to the display of the atmospheric pressure of the place where the timepiece is located, by a hand 44 facing a dial 45 both of which pivot, and a third secondary display displays the atmospheric pressure of the reference location, which results from a measurement made in said reference location, stored using a pusher 48, or which results from a setting made by a radio signal or similar, or by the user using pusher 48 provided with a setting crown, by a hand 46 facing a dial 47, bot of which pivot.

Figure 10:
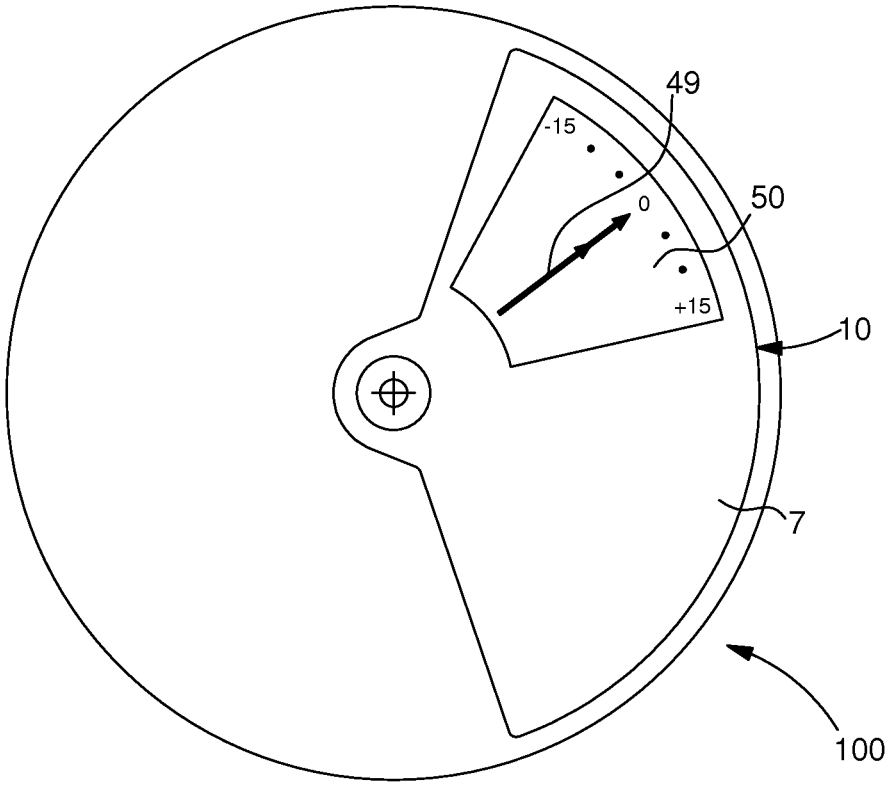
FIG. 10 shows, in a similar manner to FIG. 4, a timepiece, such as a watch, including a movement provided with a pivoting display base, wherein a first secondary display made on an oscillating weight is dedicated to the display of the rate deviation calculated by an equation of time comprised in the timepiece.

FIG. 10 shows a watch 100 with a first secondary display made on an oscillating weight 7 is dedicated to the display of the deviation in rate calculated by an equation of time of the timepiece, by a hand 49 facing a dial 50, both of which pivot.

FIG. 11 shows, purely for didactic purposes, a movement 1 with a pivoting display base 10, in an embodiment where the movement includes two output wheel sets 3D and 3U for controlling the display of the values of the tens and units of a date. Display base 10 has two inputs 11D and 11U, and includes an output display for each of these inputs, respectively formed by a tens wheel 34 and a unit crown 33, respectively pivoting about second DS2 and first DS1 secondary pivot axes, and a single supplementary output display 30 for these two output displays which carries both, and a cover 31 including a read aperture 32 which only reveals the current date. Planetary wheel carrier 30 includes a toothing 30A, which meshes with an intermediate train 21, which meshes with toothing 17A representing the angular position of oscillating weight 7 which forms display base 10. Unit crown 33 meshes with an intermediate wheel 35 which meshes with a toothing 36A of an arbour 36 carrying a unit wheel 12U, which meshes with an intermediate wheel 14U meshing in turn with unit input 11U.

Tens wheel 34 is connected to a pinion 37 which meshes with an intermediate pinion 38, which meshes with a toothing 39 of a tens wheel 12D which has another peripheral toothing that meshes with an intermediate wheel 14D meshing in turn with the tens input 11D.

Numerous variants may be envisaged. In a non-limiting manner, the means of generating a time magnitude 2A can thus consists of a means of generating a date, or a means of generating a time display, or a means of generating a moon phase indicator, or a means of generating an equation of time, or a means of generating a running equation of time, or a means of generating a time zone, or a means of generating a chronograph measurement.

The means of detecting the state 2B of a timepiece control member may be connected to the detection of the position of a pusher comprised in the timepiece movement, or of a selector, an on/off switch, a zero reset indication, an activated time zone indication, or the detection of a timed event from among several events timed at the same time.

The means 2C of measuring a physical magnitude external to the timepiece movement may include at least one barometric sensor, for measuring at altitude or during a dive, or a radioactivity, magnetic or electrical field, brightness, sound level, vibration or other sensor.

In a particular embodiment, movement 1 according to the invention includes at least one display face which includes an area of revolution which is entirely formed by display base 10 which includes, coaxial to the main pivot axis DP about which it pivots, a tubular means of passage for at least one cannon-pinion or a stem for accommodating a hand or a disc or another display means driven by movement 1.

In a particular embodiment, not shown in the Figures, this movement 1 includes, in addition to this display face, another display face which is opposite thereto and which includes at least one other display means driven by movement 1.

The invention also concerns a timepiece 100 particularly a watch, including at least one such timepiece movement 1. In a particular embodiment, the timepiece 100 is a reversible watch.

Among the applications which are particularly well suited for display on a display base such as an oscillating weight, the following can also be cited in a non-limiting manner:

the equation of time, as seen in FIG. 10;
the display of the simple and leap years;
the day of the week display;
the AM/PM display.
the day/night display.

These applications utilise the coaxial secondary axes. Other applications may use non-coaxial secondary axes:

displays that are not entirely of revolution, for example resulting from the combination of the motion of a pinion with a straight or curved rack section;

displays resulting from the superposition of at least partially overlapping discs, for example discs polarised so that, in some relative angular positions, the area of overlap is light, and in some other angular positions, the area of overlap is dark. This type of display is particularly suitable for a stop/start state display, and because there is no requirement for a reference member oriented in relation to the plate of the movement or to the watch case, it is unnecessary to install a gear train for correcting the angular position of the display base relative to the plate or to the case.

The invention claimed is:

1. A timepiece movement including a source of motion secured to a plate or a bridge comprised in said movement, said source of motion generating a magnitude and driving at least one output wheel set, the position of said output wheel set being linked to an instantaneous value of said magnitude, wherein said instantaneous value is displayed on a display base swiveling relative to said source of motion and including at least one display wheel set cooperating with said output wheel set with which said display wheel set remains coupled, directly or via a gear train, said display wheel set including a moon phase disc fixed to a wheel, which is connected to said input wheel via an intermediate gear train, and said input wheel being arranged to mesh permanently with said output wheel set, and wherein said display base carries at least one supplementary wheel set pivoting synchronously, or in an integer pivoting velocity ratio relative to said display wheel set, wherein said display base includes a means of kinematic connection to an oscillating weight of a self-winding mechanism or said base forms an oscillating weight of a self-winding mechanism, and wherein said display wheel set and said output wheel set remain coupled together during self-winding of the self-winding mechanism and after winding is completed such that said display wheel set and said output wheel set are coupled during normal time keeping operation and driving of a time keeping display of the display wheel set.

2. The timepiece movement according to claim 1, wherein said display base includes a means of kinematic connection to an oscillating weight of a self-winding mechanism.

3. The timepiece movement according to claim 1, wherein said display base forms an oscillating weight of a self-winding mechanism.

4. The timepiece movement according to claim 1, wherein said output wheel set is a single output wheel set, said timepiece movement includes a cannon-pinion fixedly secured to said plate or bridge of said timepiece movement and carries a peripheral toothing used as angular pivot reference for said oscillating weight about a main pivot axis, said cannon-pinion serving as a pivotal guide for an FIRST arbor mounted integrally with said oscillating weight, said cannon-pinion also serving as a pivotal guide for an input wheel arranged to mesh permanently with said output wheel set, wherein said oscillating weight carries a said display wheel set, which is arranged to pivot about a first secondary pivot axis carried by said oscillating weight, and wherein said display wheel set remains coupled directly or indirectly, to said output wheel set during self-winding of the self-winding mechanism and after winding is completed such that said display wheel set and said output wheel set are coupled during normal time keeping operation and driving of a time keeping display of the display wheel set, and wherein said at least one supplementary display wheel set is arranged to pivot about a second secondary pivot axis also carried by said oscillating weight, said second secondary pivot axis being parallel to or merged with said first secondary pivot axis, and wherein said supplementary display wheel set is fixed to a second arbor, which carries a second wheel, which meshes with an intermediate train, which meshes with said toothing of said cannon-pinion, and wherein the gear ratios are selected, both in the drive train of said display wheel set and that of said supplementary display wheel set, so that the pivoting of said supplementary display wheel set compensates for that of said oscillating weight by a reverse motion, and so that the pivoting of said display wheel set relative to said supplementary display wheel set appears to the user to occur as though said display wheel set and said supplementary display wheel set were both fixed relative to said plate or bridge of said timepiece movement.

5. The timepiece movement according to claim 4, wherein said moon phase disc is connected to said input wheel via the intermediate gear train pivoting about an intermediate axis, and wherein said supplementary display wheel set includes a moon cover, fixed to said second arbor.

6. The timepiece movement according to claim 1, wherein said movement includes at least one second output wheel set arranged either to take a position connected to the instantaneous value of another physical magnitude, or to define a total variation range or a scale of magnitude of the value of the magnitude which defines the position of said first output wheel set.

7. The timepiece movement according to claim 1, wherein said display base includes a plurality of display wheel sets which either all cooperate with a single supplementary display wheel set, or each cooperate with a particular supplementary display wheel set.

8. The timepiece movement according to 1, wherein said display wheel set is arranged to pivot about a first secondary pivot axis carried by said display base, and further wherein said display wheel set remains coupled directly or indirectly, to said output wheel set during self-winding of the self-winding mechanism and after winding is completed such that said display wheel set and said output wheel set are coupled during normal time keeping operation and driving of a time keeping display of the display wheel set, and in that said at least one supplementary display wheel set is arranged to pivot about a second secondary pivot axis carried by said display base, said second secondary pivot axis being parallel to or merged with said first secondary pivot axis.

9. The timepiece movement according to claim 1, wherein said source of motion generates a time magnitude and includes a means of generating a date, and wherein a first secondary display is made on an oscillating weight, dedicated to the date display, with a display means formed by a hand, and a supplementary display means formed by a dial, both pivotably moveable about a secondary axis.

10. The timepiece movement according to claim 1, wherein said source of motion generates a time magnitude and includes a means of generating a time display, and wherein a secondary display made on an oscillating weight is dedicated to a twenty-four hour time display using second hands facing a secondary dial, whereas a central main display is a conventional hour display using MAIN hands facing a main dial.

11. The timepiece movement according to claim 1, wherein said source of motion generates a time magnitude and includes a means of generating a moon phase, wherein said second secondary display said oscillating weight is dedicated to the moon phase display with a display means formed by the moon phase disc, and a supplementary display means formed by a moon cover, both pivotably moveable about a secondary axis of said second arbour.

12. The timepiece movement according to claim 1, wherein said source of motion generates a time magnitude and includes a means of generating an equation of time, wherein a first secondary display made on an oscillating weight is dedicated to the display of the deviation in rate calculated by an equation of time of the timepiece, by a hand facing a dial, both of which pivot.

13. The timepiece movement according to claim 1, wherein said source of motion generates a time magnitude and includes a means of generating a running equation of time.

14. The timepiece movement according to claim 1, wherein said source of motion generates a time magnitude and includes a means of generating a time zone, and wherein a secondary display is a time zone display, and displays the time in a different time zone to that of the main display, and where two additional apertures in an oscillating weight display the sign and value of the time difference between the second time zone displayed on said oscillating weight and the first time zone of a central display of the timepiece.

15. The timepiece movement according to claim 1, wherein said source of motion generates a time magnitude and includes a means of generating a chronograph measurement.

16. The timepiece movement according to claim 1, wherein said source of motion detects the state of a control member of said timepiece movement and detects the position of a pusher comprised in said timepiece movement, and wherein a secondary display made on an oscillating weight is dedicated to the display of the state of selection of a striking mechanism, the selection being made by said pusher, by a hand facing a state indicator dial.

17. The timepiece movement according to claim 1, wherein said source of motion generates measures a physical magnitude external to said timepiece movement and includes at least one barometric sensor, and wherein a first secondary display made on an oscillating weight is dedicated to the display of an altitude relative to a reference location by a reference hand facing a reference dial, both of which pivot, whereas a second secondary display is dedicated to the display of the atmospheric pressure of the place where the timepiece is located, by a place hand facing a place dial both of which pivot, and a third secondary display displays the atmospheric pressure of the reference location, which results from a measurement made in said reference location, stored using a pusher, or which results from a setting made by a radio signal or similar, or by the user using a pusher provided with a setting crown, by a third hand facing a third dial, both of which pivot.

18. The timepiece movement according to 1, wherein said movement includes at least one display face which has an area of revolution which is entirely formed by said display base which includes, coaxial to a main pivot axis about which said display base pivots, a tubular means of passage for at least one cannon-pinion or a stem for accommodating a hand or a disc or another display means driven by said movement.

19. The timepiece movement according to the claim 18, wherein said movement includes, in addition to said at least one display face which is on a first side of said timepiece movement, another display face which is opposite thereto on a second side of said timepiece movement and which includes at least one other display means driven by said movement.

20. A timepiece including at least one timepiece movement according to claim 1.

21. The timepiece according to claim 20, wherein said timepiece is a reversible watch, and in that said movement includes at least one display face which has an area of revolution which is entirely formed by said display base which includes, coaxial to a main pivot axis about which said display base pivots, a tubular means of passage for the passage of at least one cannon-pinion or a stem for accommodating a hand or a disc or another display means driven by said movement, and in that, in addition to said at least one display face, said movement includes another display face which is opposite thereto and which includes at least one other display means driven by said movement.

* * * * *